US009605590B2

(12) United States Patent
Yamada et al.

(10) Patent No.: US 9,605,590 B2
(45) Date of Patent: Mar. 28, 2017

(54) CROSSHEAD ENGINE

(71) Applicant: IHI Corporation, Tokyo (JP)

(72) Inventors: Takeshi Yamada, Tokyo (JP); Yoshiyuki Umemoto, Aioi (JP); Machiko Kobayashi, Aioi (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 15/208,755

(22) Filed: Jul. 13, 2016

(65) Prior Publication Data

US 2016/0319738 A1 Nov. 3, 2016

Related U.S. Application Data

(63) Continuation of application No. PCT/JP2015/051207, filed on Jan. 19, 2015.

(30) Foreign Application Priority Data

Jan. 20, 2014 (JP) ..... 2014-008102

(51) Int. Cl.
*F02D 15/02* (2006.01)
*F02B 75/04* (2006.01)
(Continued)

(52) U.S. Cl.
CPC ..... *F02B 75/045* (2013.01); *F02B 75/047* (2013.01); *F02B 75/32* (2013.01);
(Continued)

(58) Field of Classification Search
CPC ..... F02D 19/061; F02D 41/0205; F02D 41/1446; F02D 41/1458; F02D 41/18;
(Continued)

(56) References Cited

U.S. PATENT DOCUMENTS 1,743,558 A * 1/1930 McCabe ..... F02B 25/00 123/48 R
2,250,492 A * 7/1941 Miller ..... F02B 25/00 123/197.4
(Continued)

FOREIGN PATENT DOCUMENTS

DE 198 35 146 A1 6/1999
EP 2 687 707 A2 1/2014
(Continued)

*Primary Examiner* — Hung Q Nguyen
(74) *Attorney, Agent, or Firm* — Rothwell, Figg, Ernst & Manbeck, P.C.

(57) ABSTRACT

Provided is a crosshead engine that includes: a cylinder; a piston; a piston rod; a crosshead; a connecting rod; a crankshaft; and a variable mechanism varies positions of top and bottom dead centers of the piston by changing a relative position between the piston rod and the crosshead in a stroke direction of the piston. The variable mechanism includes: a hydraulic pressure chamber which is provided in the crosshead and into which an end of the piston rod is inserted; and a hydraulic pressure adjustment mechanism which supplies hydraulic oil to the hydraulic pressure chamber or discharges the hydraulic oil from the hydraulic pressure chamber and which adjusts an entering position at which the end of the piston rod is inserted into the hydraulic pressure chamber in the stroke direction.

16 Claims, 12 Drawing Sheets

(51) Int. Cl.

| | |
|---|---|
| ***F02B 75/32*** | (2006.01) |
| ***F04B 19/22*** | (2006.01) |
| ***F15B 11/08*** | (2006.01) |
| *F02B 25/04* | (2006.01) |

(52) U.S. Cl.
CPC ..... *F04B 19/22* (2013.01); *F15B 11/08* (2013.01); *F02B 25/04* (2013.01); *F02D 15/02* (2013.01); *F15B 2211/50554* (2013.01); *F15B 2211/7051* (2013.01)

(58) Field of Classification Search
CPC ..... F02D 41/0025; F02D 41/0027; F02D 19/0647; F02D 19/081; F02D 35/023; F02D 35/027; F02D 2200/0414; F02D 2200/10; Y02T 10/36
See application file for complete search history.

(56) References Cited

U.S. PATENT DOCUMENTS

| | | | | | |
|---|---|---|---|---|---|
| 3,200,798 | A * | 8/1965 | Mansfield | F02B 75/044 | 123/48 B |
| 3,450,111 | A * | 6/1969 | Cronstedt | F02B 25/00 | 123/48 B |
| 3,604,204 | A * | 9/1971 | Conrad | F02B 75/28 | 123/197.1 |
| 4,140,091 | A | 2/1979 | Showers, Jr. | | |
| 5,509,382 | A * | 4/1996 | Noland | F02B 33/16 | 123/66 |
| 5,960,750 | A * | 10/1999 | Kreuter | F02B 75/045 | 123/48 B |
| 6,966,282 | B2 | 11/2005 | Hirano | | |
| 2005/0056239 | A1 | 3/2005 | Hirano | | |
| 2009/0205615 | A1 | 8/2009 | Cannata | | |
| 2010/0139479 | A1 * | 6/2010 | Pirault | F02B 75/044 | 92/181 P |
| 2014/0366834 | A1 | 12/2014 | Melde-Tuczai | | |

FOREIGN PATENT DOCUMENTS

| | | | |
|---|---|---|---|
| JP | 63-52221 | B2 | 10/1988 |
| JP | 2005-54619 | A | 3/2005 |
| JP | 2007-247415 | A | 9/2007 |
| JP | 2009-36128 | A | 2/2009 |
| JP | 2014-20375 | A | 2/2014 |
| WO | 2013/092364 | A1 | 6/2013 |

* cited by examiner

CROSSHEAD ENGINE

This application is a continuation application based on a PCT Patent Application No. PCT/JP2015/051207, filed on Jan. 19, 2015, whose priority is claimed on Japanese Patent Application No. 2014-008102, filed on Jan. 20, 2014. The contents of both the PCT Application and the Japanese Application are incorporated herein by reference.

TECHNICAL FIELD

Embodiments described herein relates to a crosshead engine in which a crosshead is fixed to a piston rod.

RELATED ART

In a crosshead engine that is widely adopted for marine engines, a crosshead is provided at an end of a piston rod of a piston. A connecting rod connects the crosshead and a crankshaft, and a reciprocating motion of the crosshead is converted into a rotating motion of the crankshaft.

An engine of Patent Document 1 is such a crosshead engine, and is configured such that a piston rod and a crankshaft are connected by a plurality of links. Thus, postures of the links are changed, thereby changing the position of a top dead center of a piston to vary the compression ratio.

CITATION LIST

Patent Document

[Patent Document 1]

Japanese Unexamined Patent Application, First Publication No. 2007-247415

SUMMARY

When the compression ratio of the engine is varied, a structure such as a connecting structure based on the plurality of links becomes complicated in the engine described in Patent Document 1 mentioned above. Also, a constitution in which a shim plate is interposed between the piston rod and a crosshead pin that fixes a crosshead main body to the piston rod is simply taken into consideration. In this constitution, when the compression ratio of the engine is changed, it is assumed that the shim plate is replaced with another shim plate having a different thickness. However, in this case, whenever the compression ratio of the engine is changed, the engine should be stopped.

The present disclosure is made in view of this problem, and an object thereof is to provide a crosshead engine capable of changing the compression ratio while an engine being driven.

To resolve the problem, a crosshead engine of the present disclosure includes: a cylinder; a piston configured to slide in the cylinder; a piston rod having one end fixed to the piston; a crosshead connected to the other end side of the piston rod and configured to reciprocate together with the piston; a connecting rod having one end supported by the crosshead; a crankshaft connected to the connecting rod and configured to rotate in coordination with the reciprocation of the piston and the reciprocation of the crosshead; and a variable mechanism configured to vary the positions of top and bottom dead centers of the piston by changing the relative position of the piston rod and the crosshead in a stroke direction of the piston.

Further, the variable mechanism includes: a hydraulic pressure chamber which is provided in the crosshead and into which an end of the piston rod is inserted; and a hydraulic pressure adjustment mechanism which supplies hydraulic oil to the hydraulic pressure chamber or discharges the hydraulic oil from the hydraulic pressure chamber and which adjusts an entering position at which the end of the piston rod is inserted into the hydraulic pressure chamber in the stroke direction.

According to the crosshead engine of the present disclosure, it is possible to change the compression ratio in a simple structure while the engine is being driven.

DESCRIPTION OF EMBODIMENTS

Figure 1:
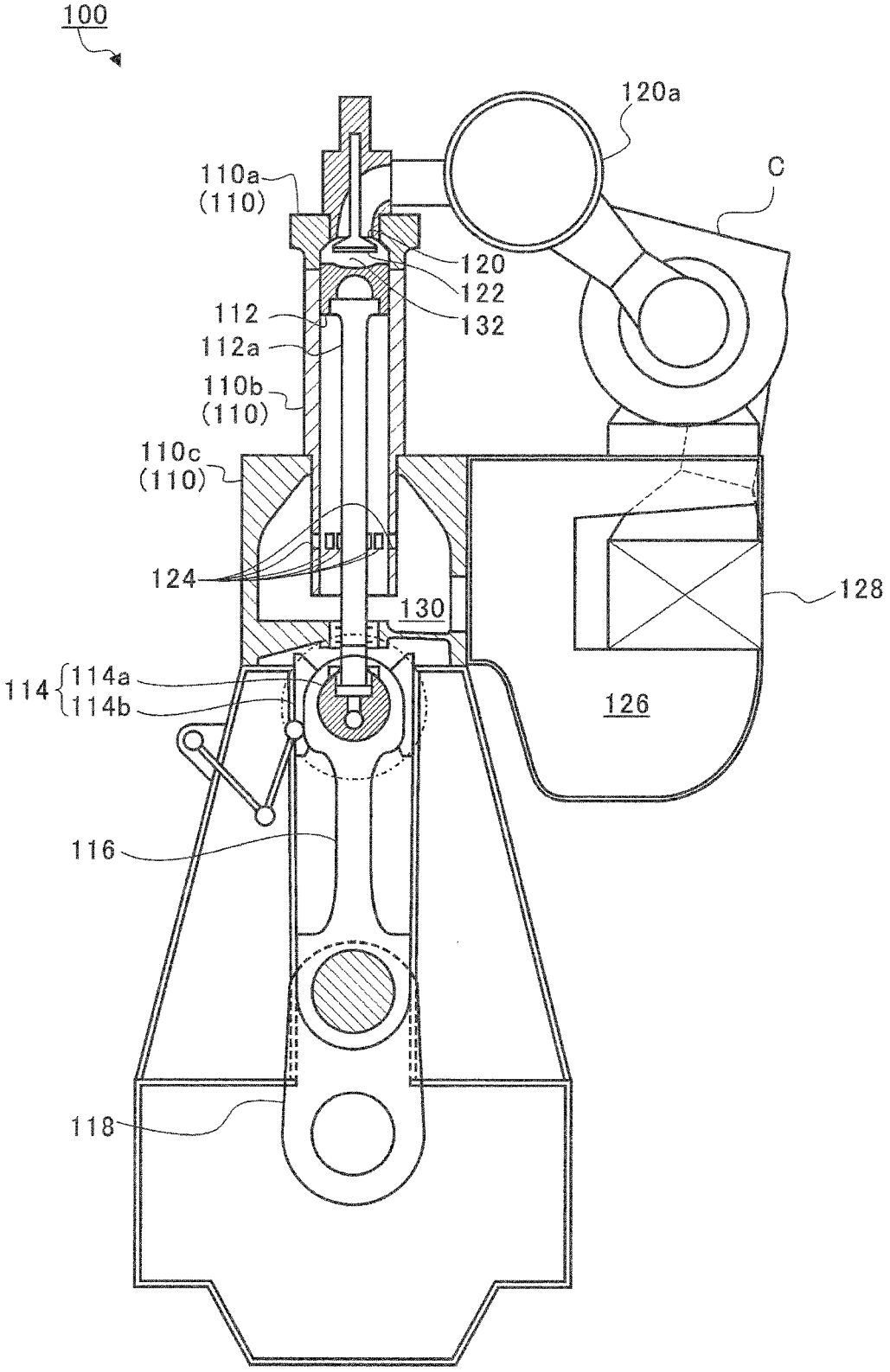
FIG. 1 is a view showing the entire constitution of a uniflow scavenging two-cycle engine.

Hereinafter, a preferred embodiment of the present disclosure will be described in detail with reference to the attached drawings. Dimensions, materials, other specific numerical values, and so on indicated in these embodiments are merely examples for facilitating comprehension of the disclosure, and unless indicated otherwise, the present disclosure is not limited thereto. Note that in the specification and drawings, elements having substantially the same functions and constitutions will be given the same reference signs, and a duplicate description thereof will be omitted. Further, elements not directly related to the present disclosure are not shown in the drawings.

In the following embodiment, a so-called dual fuel engine capable of selectively performing any one of a gas operation mode in which a fuel gas that is a gas fuel is mainly burnt and a diesel operation mode in which a fuel oil that is a liquid fuel is burnt is described. Also, a case in which the engine is a uniflow scavenging type in which two cycles (two strokes) constitutes one period and a gas flows within a cylinder in one direction is described. However, a type of the engine to which the present disclosure is applied is not limited to a dual fuel type, a two cycle type, or a uniflow scavenging type, and the engine may be a crosshead engine.

FIG. 1 is a view showing an entire constitution of a uniflow scavenging two-cycle engine (a crosshead engine) 100. The uniflow scavenging two-cycle engine 100 of the present embodiment is used in, for instance, a ship. To be specific, the uniflow scavenging two-cycle engine 100 includes a cylinder 110, a piston 112, a crosshead 114, a connecting rod 116, a crankshaft 118, an exhaust port 120, an exhaust valve 122, scavenging ports 124, a scavenging reservoir 126, a cooler 128, a scavenging chamber 130, and a combustion chamber 132.

In the uniflow scavenging two-cycle engine 100, exhaust, intake, compression, combustion, and expansion are performed between two strokes, upstroke and downstroke, of the piston 112, and the piston 112 reciprocates in the cylinder 110. One end of a piston rod 112*a* is fixed to the piston 112. Also, a crosshead pin 114*a* of the crosshead 114 is connected to the other end of the piston rod 112*a*, and the crosshead 114 reciprocates along with the piston 112. Movement of the crosshead 114 in a direction (a left/right direction in FIG. 1) perpendicular to a stroke direction of the piston 112 is regulated by the crosshead shoe 114*b*.

The crosshead pin 114*a* is inserted into a hole provided in one end of the connecting rod 116, and supports the one end of the connecting rod 116. Also, the other end of the connecting rod 116 is connected to the crankshaft 118, and the crankshaft 118 is structured to rotate relative to the connecting rod 116. As a result, when the crosshead 114 reciprocates according to the reciprocation of the piston 112, the crankshaft 118 rotates in coordination with the reciprocation.

The exhaust port 120 is an opening provided in a cylinder head 110*a* above the top dead center of the piston 112, and is opened and closed to exhaust a post-combustion exhaust gas generated in the cylinder 110. The exhaust valve 122 slides up and down at a predetermined timing by means of an exhaust valve drive (not shown), and opens and closes the exhaust port 120. The exhaust gas exhausted via the exhaust port 120 in this way is supplied to a turbine side of a supercharger C via an exhaust pipe 120*a*, and then is exhausted to the outside.

The scavenging ports 124 are holes that penetrate from an inner circumferential surface of a lower end side of the cylinder 110 (an inner circumferential surface of a cylinder liner 110*b*) to an outer circumferential surface, and are provided throughout the circumference of the cylinder 110 in a plural number. Thus, an active gas is suctioned from the scavenging ports 124 into the cylinder 110 according to the sliding motion of the piston 112. This active gas contains an oxidant such as oxygen, ozone, or the like, and a mixture thereof (e.g., air).

The scavenging reservoir 126 is filled with an active gas (e.g., air) pressurized by a compressor of the supercharger C, and the active gas is cooled by the cooler 128. The cooled active gas is pressed into the scavenging chamber 130 formed in a cylinder jacket 110*c*. Thus, the active gas is suctioned from the scavenging ports 124 into the cylinder 110 by a differential pressure between the scavenging chamber 130 and the inside of the cylinder 110.

Further, the cylinder head 110*a* is provided with a pilot injection valve (not shown). In the gas operation mode, a moderate amount of fuel oil is injected from the pilot injection valve at a desired point in time in an engine cycle. This fuel oil is evaporated by heat of the combustion chamber 132 surrounded with the cylinder head 110*a*, the cylinder liner 110*b*, and the piston 112, is spontaneously ignited along with the fuel gas, and is burnt in a short time to greatly raise a temperature of the combustion chamber 132. As a result, the fuel gas flowing into the cylinder 110 can be reliably burnt at a desired timing. The piston 112 reciprocates according to an expansion pressure that is mainly caused by the combustion of the fuel gas.

Here, the fuel gas gasifies and produces, for instance, liquefied natural gas (LNG). Also, the fuel gas is not limited to LNG, and liquefied petroleum gas (LPG), or a substance obtained by gasification of gas oil, heavy oil, or the like may be applied.

On the other hand, in the diesel operation mode, the fuel oil, an amount of which is larger than an amount of injection of the fuel oil in the gas operation mode, is injected from the pilot injection valve. The piston 112 reciprocates according to an expansion pressure that is caused by the combustion of the fuel oil rather than the fuel gas.

In this way, the uniflow scavenging two-cycle engine 100 selectively carries out any one of the gas operation mode and the diesel operation mode. Thus, to vary the compression ratio of the piston 112 depending on the selected mode, the uniflow scavenging two-cycle engine 100 is provided with a variable mechanism. Hereinafter, the variable mechanism will be described in detail.

Figure 2A:
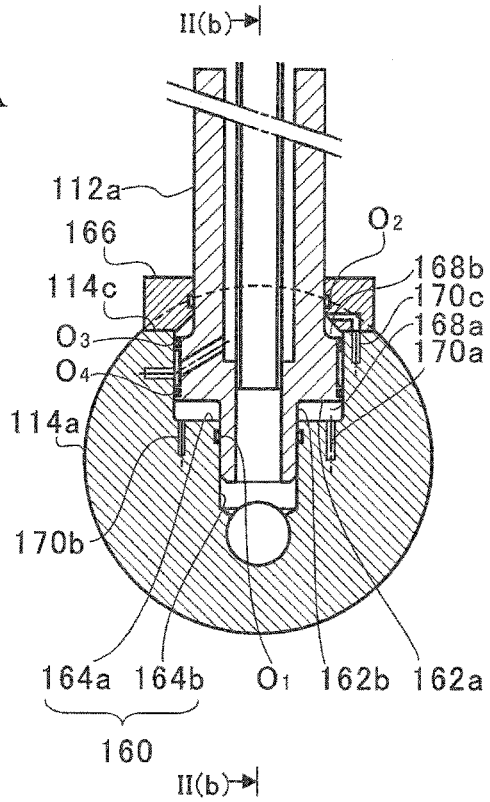
FIG. 2A is a view showing the connecting portion between a piston rod and a crosshead pin, and is an enlarged view of a portion surrounded by a dot-and-dash line of FIG. 1.
Figure 2B:
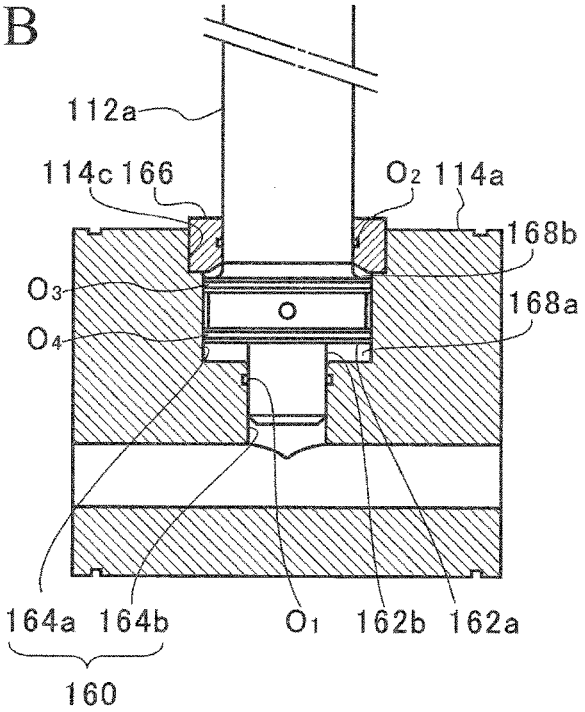
FIG. 2B is a sectional view taken along a line II(b)-II(b) of FIG. 2A.

FIGS. 2A and 2B are views showing a connecting portion between the piston rod 112*a* and the crosshead pin 114*a*. In FIG. 2A, a portion surrounded by a dot-and-dash line of FIG. 1 is shown in an enlarged view. In FIG. 2B, a cross section taken along a line II(b)-II(b) of FIG. 2A is shown.

As shown in FIGS. 2A and 2B, the other end of the piston rod 112*a* is inserted into the crosshead pin 114*a*. To be specific, the crosshead pin 114*a* is formed with a connecting hole 160 that vertically extends in an axial direction (a left/right direction in FIG. 2B) of the crosshead pin 114*a*. This connecting hole 160 serves as a hydraulic pressure chamber, and the other end (the end) of the piston rod 112*a* is inserted into (or enters) the hydraulic pressure chamber. In this way, the other end of the piston rod 112*a* is inserted into the connecting hole 160, and thereby the crosshead pin 114*a* and the piston rod 112*a* are connected to each other.

To be more specific, the piston rod 112*a* is formed with a large-diameter part 162*a* in which an outer diameter of the piston rod 112*a* is larger than one end side, and a small-diameter part 162*b* which is located at the other end side relative to the large-diameter part 162*a* and an outer diameter of which is smaller than that of the large-diameter part 162*a*.

Thus, the connecting hole 160 has a large-diameter hole part 164*a* that is located close to the piston 112, and a small-diameter hole part 164*b* which is formed continuously with the large-diameter hole part 164*a* close to the connecting rod 116 with respect to the large-diameter hole part 164*a* and an inner diameter of which is smaller than that of the large-diameter hole part 164*a*.

The small-diameter part 162*b* of the piston rod 112*a* can be inserted into the small-diameter hole part 164*b* of the connecting hole 160. The large-diameter part 162*a* of the piston rod 112*a* is sized to be insertable into the large-diameter hole part 164*a* of the connecting hole 160. A first seal member $O_1$ formed of an O-ring is disposed on an inner circumferential surface of the small-diameter hole part 164*b*.

A fixing lid 166, an outer diameter of which is larger than that of the connecting hole 160, is fixed at the one end side of the piston rod 112*a* relative to the large-diameter part 162*a* of the piston rod 112*a*. The fixing lid 166 is an annular member, and the piston rod 112*a* is inserted into the fixing lid 166 from the one end side of the piston rod 112*a*. A second seal member $O_2$ formed of an O-ring is disposed on an inner circumferential surface of the fixing lid 166 into which the piston rod 112*a* is inserted.

An outer circumferential surface of the crosshead pin 114*a* which is directed toward the piston 112 is formed with a pit 114*c* recessed in a radial direction of the crosshead pin 114*a*, and the fixing lid 166 is in contact with the pit 114*c*.

Also, a first hydraulic pressure chamber (a hydraulic pressure chamber) 168*a* and a second hydraulic pressure chamber 168*b* are formed in the connecting portion between the piston rod 112*a* and the crosshead pin 114*a* within the inside of the crosshead pin 114*a*.

The first hydraulic pressure chamber 168*a* is a space that is surrounded by a stepped surface produced by a difference in outer diameter between the large-diameter part 162*a* and the small-diameter part 162*b*, an inner circumferential surface of the large-diameter hole part 164*a*, and a stepped surface produced by a difference in inner diameter between the large-diameter hole part 164*a* and the small-diameter hole part 164*b*.

The second hydraulic pressure chamber 168*b* is a space that is surrounded by an end face of the large-diameter part 162*a* which is located at the one end side of the piston rod 112*a*, the inner circumferential surface of the large-diameter hole part 164*a*, and the fixing lid 166. That is, the large-diameter hole part 164*a* is partitioned into the one end side and the other end side of the piston rod 112*a* by the large-diameter part 162*a* of the piston rod 112*a*. Thus, the first hydraulic pressure chamber 168*a* is formed by the large-diameter hole part 164*a* that is partitioned into the other end side of the piston rod 112*a* relative to the large-diameter part 162*a* of the piston rod 112*a*, and the second hydraulic pressure chamber 168*b* is formed by the large-diameter hole part 164*a* that is partitioned into the one end side of the piston rod 112*a* relative to the large-diameter part 162*a* of the piston rod 112*a*.

A supply oil passage 170*a* and a discharge oil passage 170*b* communicate with the first hydraulic pressure chamber 168*a*. The supply oil passage 170*a* has one end that is open to the inner circumferential surface of the large-diameter hole part 164*a* (the stepped surface produced by the difference in inner diameter between the large-diameter hole part 164*a* and the small-diameter hole part 164*b*), and the other end that communicates with a plunger pump (to be described below). The discharge oil passage 170*b* has one end that is open to the stepped surface produced by the difference in inner diameter between the large-diameter hole part 164*a* and the small-diameter hole part 164*b*, and the other end that communicates with a spill valve (to be described below).

An auxiliary oil passage 170*c* that is open to an inner wall surface of the fixing lid 166 communicates with the second hydraulic pressure chamber 168*b*. The auxiliary oil passage 170*c* communicates with a hydraulic pump through the inside of the crosshead pin 114*a* via a contact portion between the fixing lid 166 and the crosshead pin 114*a*.

Figure 3A:
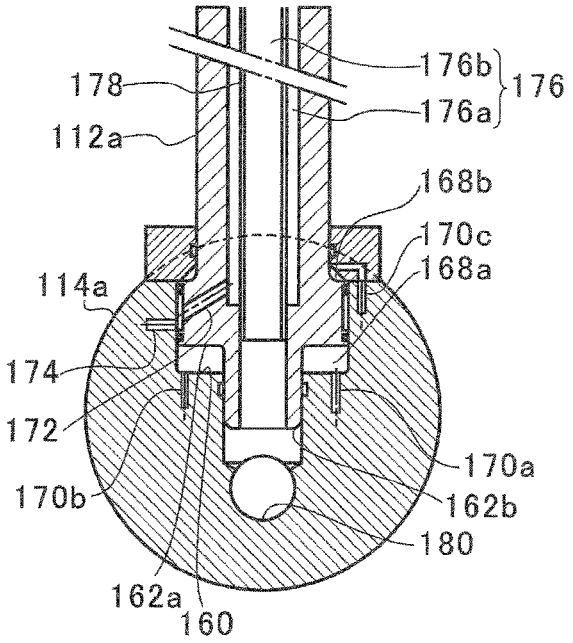
FIG. 3A is a view showing a change in relative position between the piston rod and the crosshead pin.
Figure 3B:
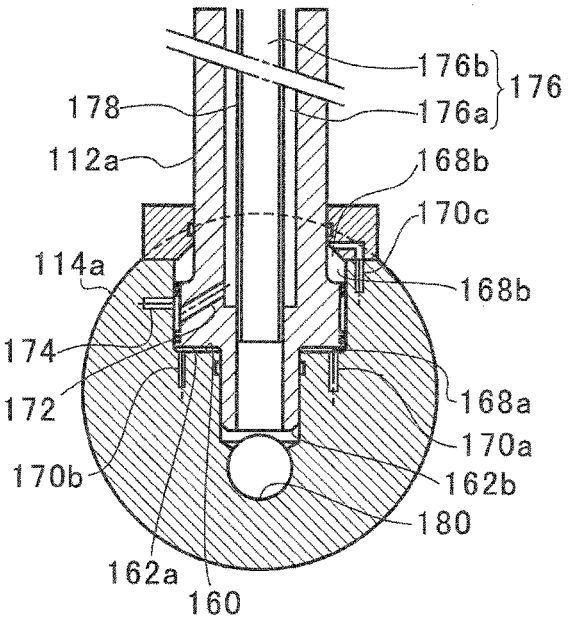
FIG. 3B is a view showing a change in relative position between the piston rod and the crosshead pin.

FIGS. 3A and 3B are views showing a change in relative position between the piston rod 112*a* and the crosshead pin 114*a*. In FIG. 3A, a state in which the piston rod 112*a* shallowly enters the connecting hole 160 is shown. In FIG. 3B, a state in which the piston rod 112*a* deeply enters the connecting hole 160 is shown.

A length of the first hydraulic pressure chamber 168*a* in the stroke direction of the piston 112 can be varied. When the first hydraulic pressure chamber 168*a* is sealed up with incompressible hydraulic oil supplied to the first hydraulic pressure chamber 168*a*, the first hydraulic pressure chamber 168*a* enables the state of FIG. 3A to be maintained because the hydraulic oil is incompressible.

Then, when the spill valve is opened, the hydraulic oil is discharged from the first hydraulic pressure chamber 168*a* through the discharge oil passage 170*b* toward the spill valve by compressive loads from the piston rod 112*a* and the crosshead pin 114*a* due to the reciprocation of the piston 112. As a result, as shown in FIG. 3B, a length of the first hydraulic pressure chamber 168*a* in the stroke direction of the piston 112 decreases. On the other hand, a length of the second hydraulic pressure chamber 168*b* in the stroke direction of the piston 112 increases.

An entering position (or an entering depth) at (to) which the piston rod 112*a* enters the connecting hole (the hydraulic pressure chamber) 160 of the crosshead pin 114*a* is changed to an extent that the lengths of the first and second hydraulic pressure chambers 168*a* and 168*b* in the stroke direction of the piston 112 are changed. In this way, the relative position between the piston rod 112*a* and the crosshead pin 114*a* is changed, and thereby positions of the top and bottom dead centers of the piston 112 are varied.

Meanwhile, when the piston 112 reaches the top dead center in the state shown in FIG. 3B, a position of the crosshead pin 114*a* in the stroke direction of the piston 112 is fixed by the connecting rod 116. On the other hand, although the piston rod 112*a* is connected to the crosshead pin 114*a*, a gap occurs in the stroke direction thereof due to the length of the second hydraulic pressure chamber 168*b*.

For this reason, depending on a rotational speed of the uniflow scavenging two-cycle engine 100, an inertial force of the piston rod 112*a* may be increased, and the piston rod 112*a* may be excessively displaced toward the piston 112. To prevent a positional shift of the top dead center from occurring in this way, a hydraulic pressure from the hydraulic pump acts on the second hydraulic pressure chamber 168*b* via the auxiliary oil passage 170*c* to suppress the movement of the piston rod 112*a* in the stroke direction.

Also, since the uniflow scavenging two-cycle engine 100 is used at a relatively low rotational speed, the inertial force of the piston rod 112*a* is weak. Therefore, although the hydraulic pressure supplied to the second hydraulic pressure chamber 168*b* is low, it is possible to suppress the positional shift of the top dead center.

Also, the piston rod 112*a* is provided with a flow passage hole 172 from the outer circumferential surface of the piston rod 112*a* (the large-diameter part 162*a*) toward an inner side in a radial direction. Also, the crosshead pin 114*a* is provided with a through-hole 174 that penetrates from the outer circumferential surface side of the crosshead pin 114*a* to the connecting hole 160 (the large-diameter hole part 164*a*). The through-hole 174 communicates with the hydraulic pump.

Also, the flow passage hole 172 and the through-hole 174 are opposite to each other in the radial direction of the piston rod 112*a*. The flow passage hole 172 and the through-hole 174 communicate with each other. An end of the flow passage hole 172 which is close to an outer circumferential surface of the flow passage hole 172 has a wider flow passage width that is formed in the stroke direction (in the up/down direction in FIGS. 3A and 3B) of the piston 112 than other parts of the flow passage hole 172. As shown in FIGS. 3A and 3B, although the relative position between the piston rod 112*a* and the crosshead pin 114*a* is changed, a state in which the flow passage hole 172 and the through-hole 174 communicate with each other is maintained.

Third and fourth seal members $O_3$ and $O_4$ formed of O-rings are disposed on the outer circumferential surface of the piston rod 112*a* (the large-diameter part 162*a*) to sandwich an end of the outer circumferential surface side of the flow passage hole 172 in the axial direction of the piston rod 112*a*.

An area of the large-diameter part 162*a* which is opposite to the inner circumferential surface of the large-diameter hole part 164*a* is reduced by an area of the flow passage hole 172, and the large-diameter part 162*a* is easily inclined with respect to the large-diameter hole part 164*a*. In contrast, the small-diameter part 162*b* is guided by the small-diameter hole part 164*b*, and thereby inclination thereof in the stroke direction of the piston rod 112*a* is suppressed.

Thus, a cooling oil passage 176 which extends in the stroke direction of the piston 112 and through which cooling oil for cooling the piston 112 and the piston rod 112*a* circulates is formed inside the piston rod 112*a*. The cooling oil passage 176 is divided into an outward passage 176*a* of an outer side and a return passage 176*b* of an inner side in the radial direction of the piston rod 112*a* by a cooling pipe 178 that is disposed therein and extends in the stroke direction of the piston 112. The flow passage hole 172 is open to the outward passage 176*a* of the cooling oil passage 176.

The cooling oil supplied from the hydraulic pump flows into the outward passage 176*a* of the cooling oil passage 176 via the through-hole 174 and the flow passage hole 172. The outward passage 176*a* and the return passage 176*b* communicate with each other in the piston 112. When the cooling oil flowing through the outward passage 176*a* reaches an inner wall of the piston 112, it returns to the small-diameter part 162*b* side through the return passage 176*b*. The cooling oil comes into contact with an inner wall of the cooling oil passage 176 and the inner wall of the piston 112, and thereby the piston 112 is cooled.

Also, the crosshead pin 114*a* is formed with an outlet hole 180 extending in the axial direction of the crosshead pin 114*a*, and the small-diameter hole part 164*b* communicates with the outlet hole 180. After the piston 112 is cooled, the cooling oil flowing from the cooling oil passage 176 into the small-diameter hole part 164*b* is discharged to the outside of the crosshead pin 114*a* through the outlet hole 180, and flows back to the tank.

Both of the hydraulic oil supplied to the first and second hydraulic pressure chambers 168*a* and 168*b* and the cooling oil supplied to the cooling oil passage 176 flow back to the tank, and are increased in pressure by the same hydraulic pump. For this reason, the supply of the hydraulic oil applying the hydraulic pressure and the supply of the cooling oil for the cooling can be performed by one hydraulic pump, and costs can be reduced.

The variable mechanism making the compression ratio of the piston 112 variable includes a hydraulic pressure adjustment mechanism that adjusts the hydraulic pressure of the first hydraulic pressure chamber 168*a* in addition to the first hydraulic pressure chamber 168*a*. Next, the hydraulic pressure adjustment mechanism will be described in detail.

Figure 4:
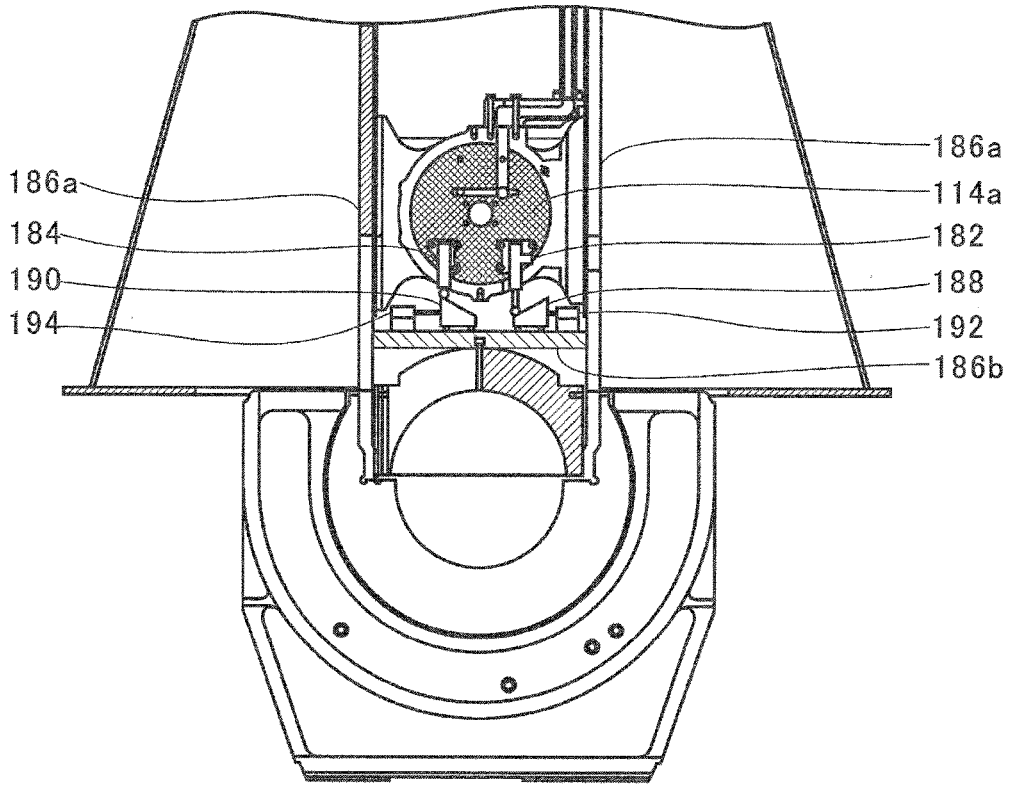
FIG. 4 is a view showing the disposition of a plunger pump and a spill valve.

FIG. 4 is a view showing disposition of the plunger pump 182 and the spill valve 184, and shows an appearance and a partial cross section of the uniflow scavenging two-cycle engine 100 in the vicinity of the crosshead 114. The plunger pump 182 and the spill valve 184 are fixed to the crosshead pin 114*a* indicated in FIG. 4 by crosshatching.

An engine bridge 186*b*, opposite ends of which are fixed to two guide plates 186*a* guiding the reciprocation of the crosshead 114 and which supports both of the guide plates 186*a*, is disposed below the plunger pump 182 and the spill valve 184. A first cam plate 188 and a second cam plate 190 are placed on the engine bridge 186*b*, and the first cam plate 188 and the second cam plate 190 are configured to be movable on the engine bridge 186*b* in the left/right direction in FIG. 4 by a first actuator 192 and a second actuator 194 respectively.

The plunger pump 182 and the spill valve 184 reciprocate in the stroke direction of the piston 112 together with crosshead pin 114*a*. On the other hand, the first cam plate 188 and the second cam plate 190 are on the engine bridge 186*b*, and do not move relative to the engine bridge 186*b* in the stroke direction of the piston 112.

Figure 5:
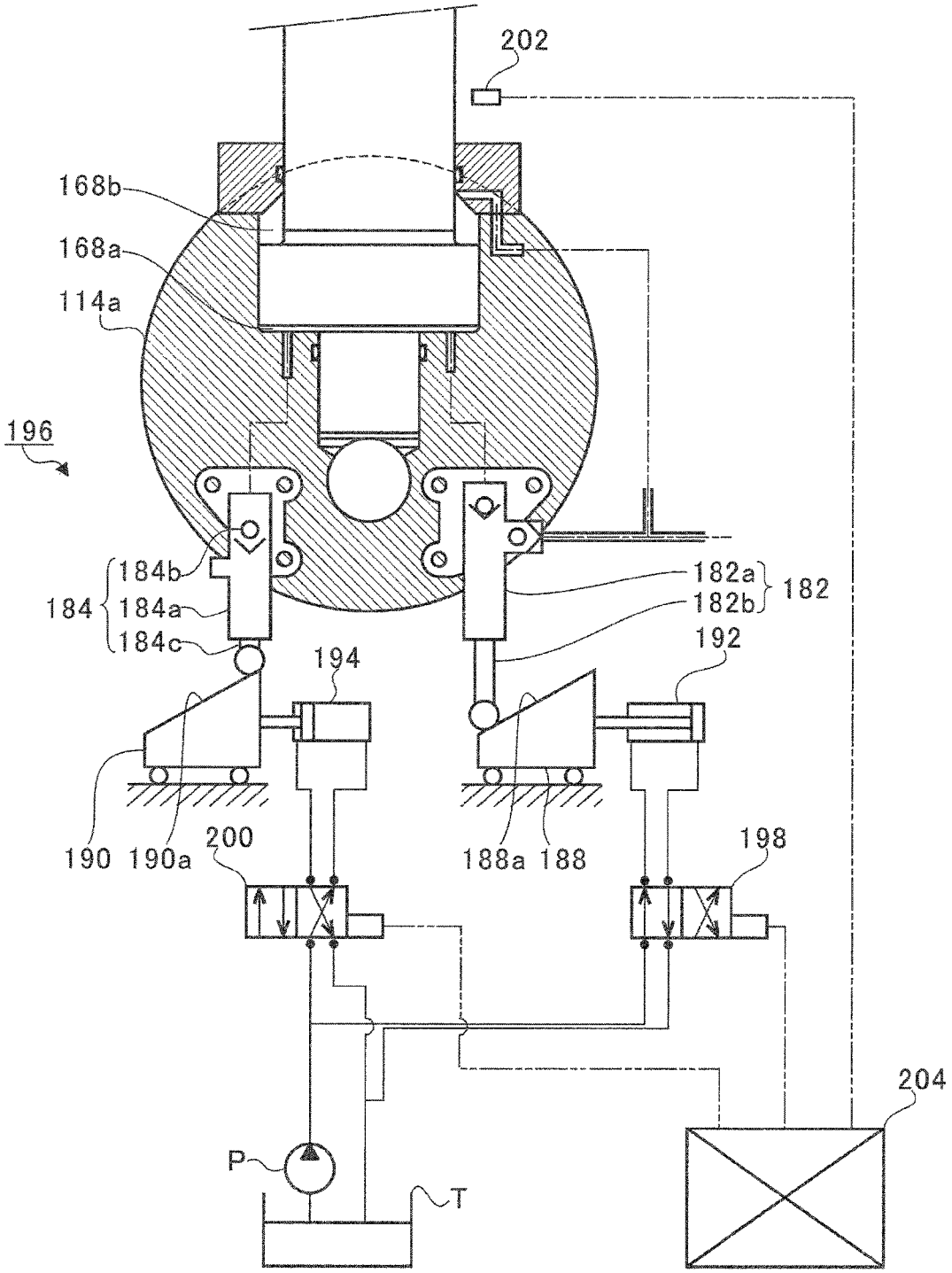
FIG. 5 is a view showing the constitution of a hydraulic pressure adjustment mechanism.

FIG. 5 is a view showing a constitution of the hydraulic pressure adjustment mechanism 196. As shown in FIG. 5, the hydraulic pressure adjustment mechanism 196 includes the plunger pump 182, the spill valve 184, the first cam plate 188, the second cam plate 190, the first actuator 192, the second actuator 194, a first switching valve 198, a second switching valve 200, a position sensor 202, and a hydraulic control unit 204.

The plunger pump 182 includes a pump cylinder 182*a* and a plunger 182*b*. The hydraulic oil is guided to the inside of the pump cylinder 182*a* via an oil passage communicating with the hydraulic pump P. The plunger 182*b* moves in the pump cylinder 182*a* in a stroke direction, and one end thereof protrudes from the pump cylinder 182*a*.

The first cam plate 188 has an inclined surface 188*a* inclined with respect to the stroke direction of the piston 112, and is disposed below the plunger pump 182 in the stroke direction. When the plunger pump 182 moves in the stroke direction along with the crosshead pin 114*a*, one end of the plunger 182*b* protruding from the pump cylinder 182*a* comes into contact with the inclined surface 188*a* of the first cam plate 188 at a crank angle close to the bottom dead center.

Thus, the plunger 182*b* receives a reaction force resistant to a reciprocating force of the crosshead 114 from the inclined surface 188*a* of the first cam plate 188, and is pushed into the pump cylinder 182*a*. The plunger 182*b* is pushed into the pump cylinder 182*a*, and thereby the plunger pump 182 supplies (or presses) the hydraulic oil in the pump cylinder 182*a* into the first hydraulic pressure chamber 168*a*.

The first actuator 192 is operated by, for instance, the hydraulic pressure of the hydraulic oil supplied via the first switching valve 198, and displaces the first cam plate 188 in a direction (here, a direction perpendicular to the stroke direction) that intersects the stroke direction. That is, the first actuator 192 causes the relative position of the first cam plate 188 with respect to the plunger 182*b* to be changed by the movement of the first cam plate 188.

In this way, when the first cam plate 188 is displaced in the direction perpendicular to the stroke direction, a contact position between the plunger 182*b* and the first cam plate 188 in the stroke direction is relatively changed. For example, when the first cam plate 188 is displaced to the left side in FIG. 5, the contact position is displaced upward in the stroke direction, and when the first cam plate 188 is displaced to the right side in FIG. 5, the contact position is displaced downward in the stroke direction. Thus, a maximum pushing amount for the pump cylinder 182*a* is set by this contact position.

The spill valve 184 includes a main body 184*a*, a valve body 184*b*, and a rod 184*c*. An internal flow passage through which the hydraulic oil discharged from the first hydraulic pressure chamber 168*a* circulates is formed in the main body 184*a* of the spill valve 184. The valve body 184*b* is disposed in the internal flow passage inside the main body 184*a*. One end of the rod 184*c* faces the valve body 184*b* inside the main body 184*a*, and the other end of the rod 184*c* protrudes from the main body 184*a*.

The second cam plate 190 has an inclined surface 190*a* inclined with respect to the stroke direction, and is disposed below the rod 184*c* in the stroke direction. Thus, when the spill valve 184 moves in the stroke direction along with the crosshead pin 114*a*, the one end of the rod 184*c* protruding from the main body 184*a* of the spill valve 184 comes into contact with the inclined surface 190*a* of the second cam plate 190 at the crank angle close to the bottom dead center.

Thus, the rod 184*c* receives the reaction force resistant to the reciprocating force of the crosshead 114 from the inclined surface 190*a* of the second cam plate 190, and is pushed into the main body 184*a*. The rod 184*c* of the spill valve 184 is pushed into the main body 184*a* at a predetermined amount or more, and thereby the valve body 184*b* moves, and the hydraulic oil can circulate through the internal flow passage of the spill valve 184. The hydraulic oil is discharged from the first hydraulic pressure chamber 168*a* toward the tank T.

The second actuator 194 is operated by, for instance, the hydraulic pressure of the hydraulic oil supplied via the second switching valve 200, and displaces the second cam plate 190 in a direction (here, a direction perpendicular to the stroke direction) that intersects the stroke direction. That is, the second actuator 194 causes a relative position of the second cam plate 190 with respect to the rod 184*c* to be changed by the movement of the second cam plate 190.

Depending on the relative position of the second cam plate 190, a contact position between the rod 184*c* and the second cam plate 190 in the stroke direction is changed. For example, when the second cam plate 190 is displaced to the left side in FIG. 5, the contact position is displaced upward in the stroke direction, and when the second cam plate 190 is displaced to the right side in FIG. 5, the contact position is displaced downward in the stroke direction. Thus, a maximum pushing amount for the spill valve 184 is set by this contact position.

The position sensor 202 detects a position of the piston rod 112*a* in the stroke direction, and outputs a signal indicating the position in the stroke direction.

The hydraulic control unit 204 receives the signal from the position sensor 202, and specifies the relative position between the piston rod 112*a* and the crosshead pin 114*a*. Thus, the hydraulic control unit 204 drives the first actuator 192 and the second actuator 194 to adjust a hydraulic pressure (an amount of the hydraulic oil) in the first hydraulic pressure chamber 168*a* such that the relative position between the piston rod 112*a* and the crosshead pin 114*a* becomes a setting position.

In this way, the hydraulic pressure adjustment mechanism 196 supplies the hydraulic oil to the first hydraulic pressure chamber 168*a* or discharges the hydraulic oil from the first hydraulic pressure chamber 168*a*. Next, specific constitutions of the plunger pump 182 and the spill valve 184 will be described in detail.

Figure 6A:
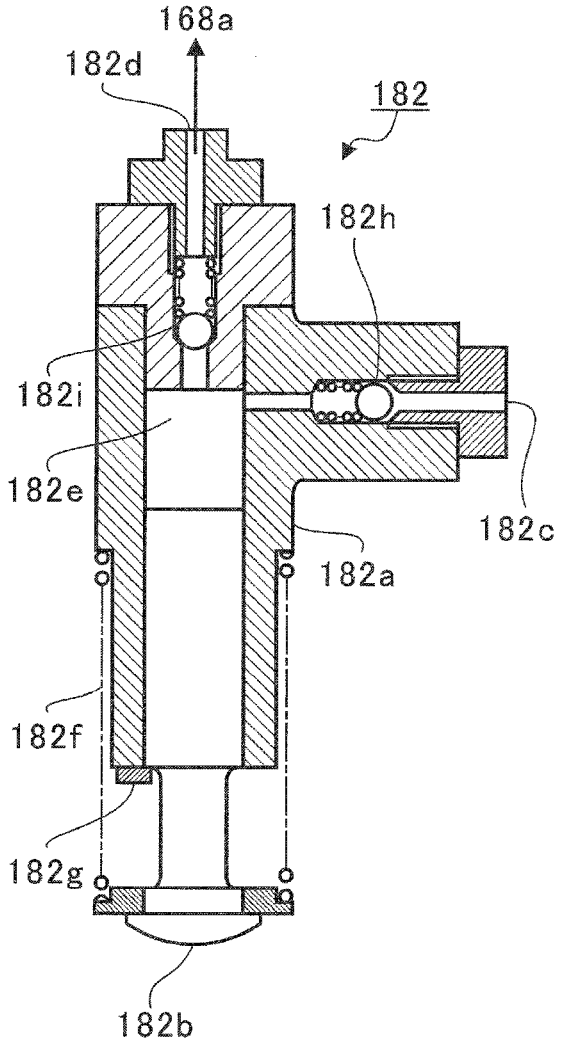
FIG. 6A is a view showing the constitution of the plunger pump.
Figure 6B:
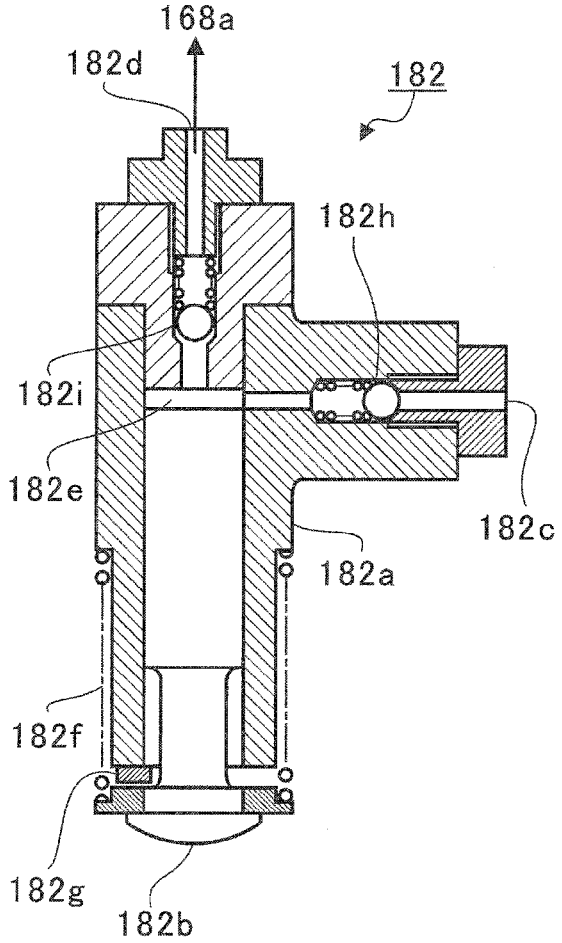
FIG. 6B is a view showing the constitution of the plunger pump.

FIGS. 6A and 6B are views showing a constitution of the plunger pump 182, and show a cross section based on a plane including a central axis of the plunger 182*b*. As shown in FIG. 6A, the pump cylinder 182*a* is provided with an inflow port 182*c* into which the hydraulic oil supplied from the hydraulic pump P flows, and a discharge port 182*d* to which the hydraulic oil is discharged from the pump cylinder 182*a* toward the first hydraulic pressure chamber 168*a*.

The hydraulic oil flowing in from the inflow port 182*c* is stored in an oil storage chamber 182*e* inside the pump cylinder 182*a*. Thus, as shown in FIG. 6B, when the plunger 182*b* is pushed into the pump cylinder 182*a*, the hydraulic oil of the oil storage chamber 182*e* is pressed by the plunger 182*b*, and is supplied from the discharge port 182*d* to the first hydraulic pressure chamber 168*a*.

A biasing part 182*f* is formed of, for instance, a coil spring, and is configured such that one end thereof is fixed to the pump cylinder 182*a* and the other end thereof is fixed to the plunger 182*b*. Thus, when the plunger 182*b* is pushed into the pump cylinder 182*a*, a biasing force pushing the plunger 182*b* back is applied to the plunger 182*b*.

For this reason, when the plunger 182*b* is displaced in a direction separated from the first cam plate 188 in the state shown in FIG. 6B according to the movement of the crosshead pin 114*a*, the plunger 182*b* returns to the position shown in FIG. 6A according to the biasing force of the plunger 182*b*. A retaining member 182*g* regulates the displacement of the plunger 182*b* in a direction protruding from the pump cylinder 182*a* so that it does not fall off of the pump cylinder 182*a*. In this process of the displacement of the plunger 182*b*, the hydraulic oil flows from the inflow port 182*c* into the oil storage chamber 182*e*. The hydraulic oil flowing into the oil storage chamber 182*e* is supplied from the discharge port 182*d* toward the first hydraulic pressure chamber 168*a* when the plunger 182*b* is pushed into the pump cylinder 182*a* in the next time.

An oil passage communicating the oil storage chamber 182*e* with the inflow port 182*c* is provided with a check valve 182*h*, and has a structure in which the hydraulic oil does not flow backward from the oil storage chamber 182*e* toward the inflow port 182*c*.

Also, an oil passage communicating the discharge port 182*d* with the oil storage chamber 182*e* is provided with a check valve 182*i*, and has a structure in which the hydraulic oil does not flow backward from the discharge port 182*d* toward the oil storage chamber 182*e*.

The hydraulic oil flows from the inflow port 182*c* toward the discharge port 182*d* in one direction by means of the two check valves 182*h* and 182*i*.

Figure 7A:
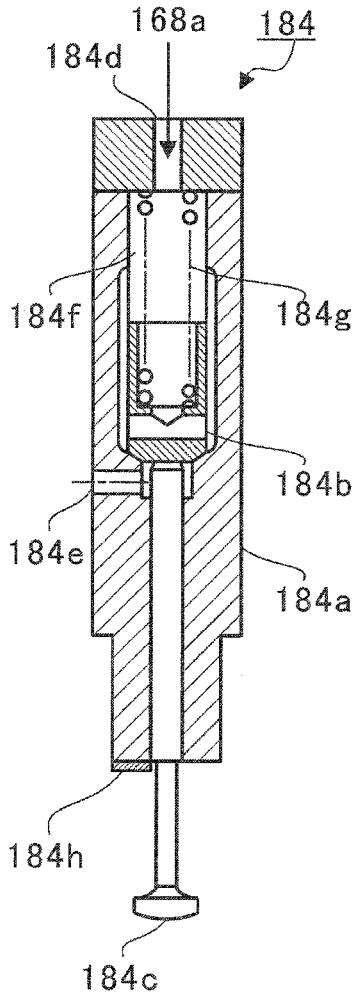
FIG. 7A is a view showing the constitution of the spill valve.
Figure 7B:
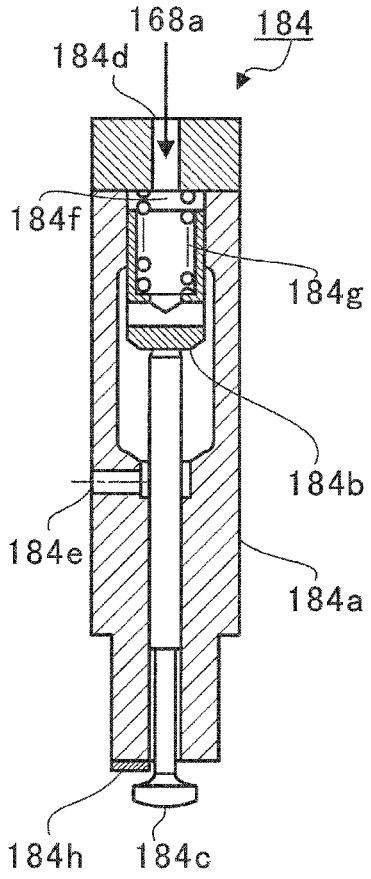
FIG. 7B is a view showing the constitution of the spill valve.

FIGS. 7A and 7B are view showing a constitution of the spill valve 184, and show a cross section based on a plane including a central axis of the rod 184*c*. As shown in FIG. 7A, the main body 184*a* of the spill valve 184 is provided with an inflow port 184*d* into which the hydraulic oil discharged from the first hydraulic pressure chamber 168*a* flows, and a discharge port 184*e* to which the hydraulic oil is discharged from the main body 184*a* of the spill valve 184 toward the tank T.

The hydraulic oil flowing in from the inflow port 184*d* circulates through an internal flow passage 184*f* inside the main body 184*a*. The valve body 184*b* is disposed in the internal flow passage 184*f*, and is configured to be movable in the internal flow passage 184*f* in the stroke direction.

Thus, the valve body 184*b* moves in the stroke direction, and thereby is displaced to a closed position at which the internal flow passage 184*f* is blocked as shown in FIG. 7A and an opened position at which the circulation of the hydraulic oil is possible in the internal flow passage 184*f* as shown in FIG. 7B.

The one end of the rod 184*c* faces the valve body 184*b* in the stroke direction. The rod 184*c* is pushed into the main body 184*a*, and thereby the valve body 184*b* is pressed by the rod 184*c* and is displaced to the opened position shown in FIG. 7B.

A biasing part 184*g* is formed of, for instance, a coil spring, and is configured such that one end thereof is fixed to the main body 184*a* of the spill valve 184 and the other end thereof is fixed to the valve body 184*b*. The biasing part 184*g* always applies a biasing force in a direction in which the valve body 184*b* blocks the internal flow passage 184*f*. Thus, when the rod 184*c* is pushed into the main body 184*a* of the spill valve 184, it resists the biasing force of the biasing part 184*g* to press the valve body 184*b*. At this point, the biasing part 184*g* applies a biasing force pushing back the valve body 184*b* to the valve body 184*b*.

For this reason, when the valve body 184*b* is located at the opened position as shown in FIG. 7B, and when the rod 184*c* is separated from the second cam plate 190 according to the movement of the crosshead pin 114*a*, the valve body 184*b* returns to the closed position shown in FIG. 7A according to the biasing force of the biasing part 184*g*. At this time, a retaining member 184*h* regulates the movement of the rod 184*c* in a direction in which the rod 184*c* protrudes from the main body 184*a* such that the rod 184*c* does not fall off of the main body 184*a* of the spill valve 184.

Figure 8A:
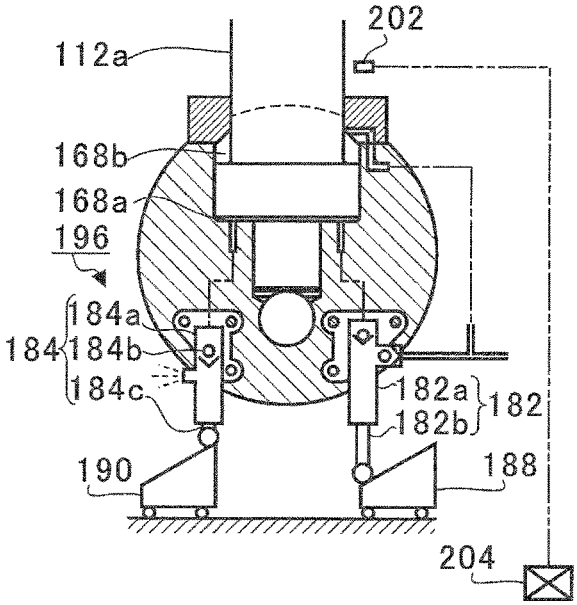
FIG. 8A is a view showing the operation of a variable mechanism.

FIGS. 8A to 8D are views showing an operation of the variable mechanism. In FIG. 8A, the relative position of the second cam plate 190 is adjusted such that the contact position between the rod 184*c* and the second cam plate 190 becomes a relatively high position. For this reason, the rod 184*c* is deeply pushed into the main body 184*a* of the spill valve 184 at the crank angle close to the bottom dead center, the spill valve 184 is opened, and the hydraulic oil is discharged from the first hydraulic pressure chamber 168*a*. At this point, since the hydraulic pressure of the hydraulic pump P is applied to the second hydraulic pressure chamber 168*b*, the relative position between the piston rod 112*a* and the crosshead pin 114*a* is stably maintained.

In this state, the top dead center of the piston 112 becomes lower (or moves toward the side of the crosshead pin 114*a*). That is, the compression ratio of the uniflow scavenging two-cycle engine 100 is reduced.

Figure 8B:
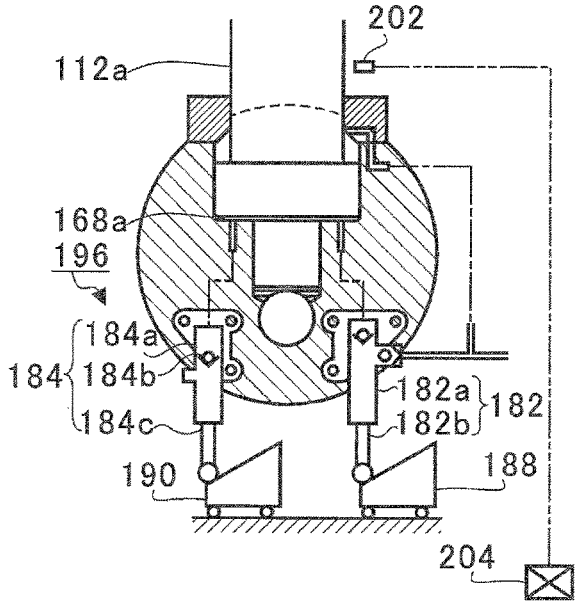
FIG. 8B is a view showing the operation of the variable mechanism.

When the hydraulic control unit 204 receives an instruction to increase the compression ratio of the uniflow scavenging two-cycle engine 100 from a host control unit such as an engine control unit (ECU), the hydraulic control unit 204 displaces the second cam plate 190 to the right side in FIG. 8B as shown in FIG. 8B. As a result, the contact position between the rod 184*c* and the second cam plate 190 is lowered, and the rod 184*c* is not pushed into the main body 184*a* even at the crank angle close to the bottom dead center and is maintained in a state in which the spill valve 184 is closed regardless of the stroke position of the piston 112. That is, the hydraulic oil inside the first hydraulic pressure chamber 168*a* is not discharged.

Figure 8C:
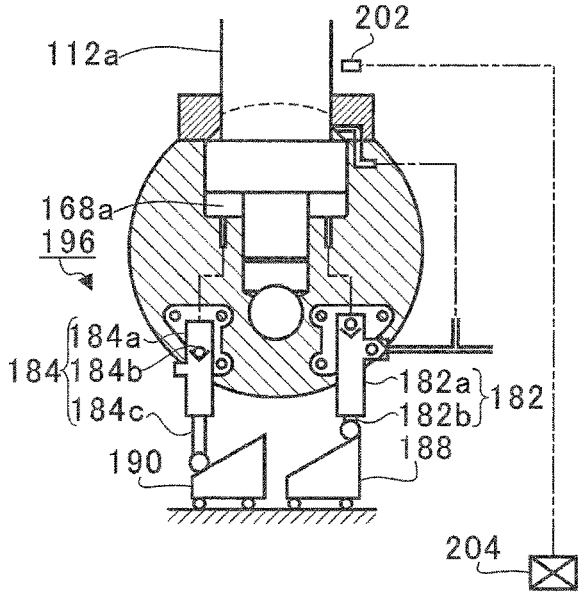
FIG. 8C is a view showing the operation of the variable mechanism.

Then, as shown in FIG. 8C, the hydraulic control unit 204 displaces the first cam plate 188 to the left side in FIG. 8C. As a result, the contact position between the plunger 182*b* and the first cam plate 188 becomes higher. Thus, when the plunger 182*b* is pushed into the pump cylinder 182*a* by the reaction force from the first cam plate 188 at the crank angle close to the bottom dead center, the hydraulic oil inside the pump cylinder 182*a* is pressed into the first hydraulic pressure chamber 168*a*.

As a result, the piston rod 112*a* is pushed upward by the hydraulic pressure, and the relative position between the piston rod 112*a* and the crosshead pin 114*a* is displaced as shown in FIG. 8C, and the top dead center of the piston 112 becomes higher (or moves away from the side of the crosshead pin 114*a*). That is, the compression ratio of the uniflow scavenging two-cycle engine 100 is increased.

The plunger pump 182 presses the hydraulic oil stored in the oil storage chamber 182*e* of the plunger pump 182 into the first hydraulic pressure chamber 168*a* at every stroke of the piston 112. In this embodiment, a maximum volume of the first hydraulic pressure chamber 168*a* is a plurality of times a maximum volume of the oil storage chamber 182*e*. For this reason, according to at which stroke of the piston 112 the plunger pump 182 is operated, an amount of the hydraulic oil pressed into the first hydraulic pressure chamber 168*a* can be adjusted, and the amount at which the piston rod 112*a* is pushed upward can be adjusted.

Figure 8D:
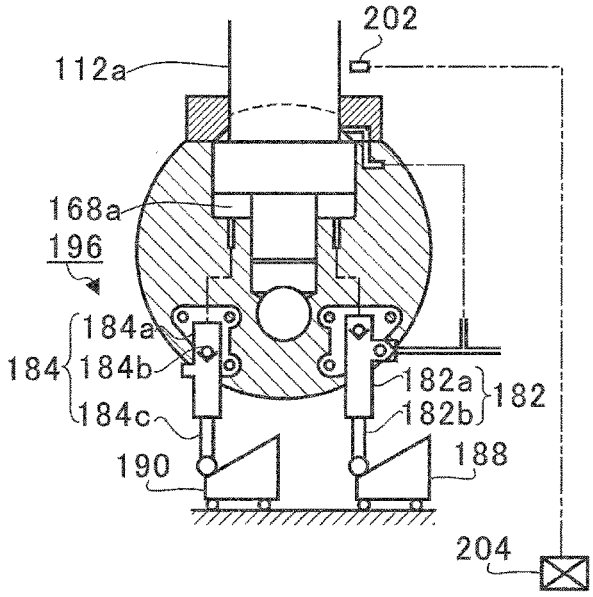
FIG. 8D is a view showing the operation of the variable mechanism.

When the relative position between the piston rod 112*a* and the crosshead pin 114*a* becomes a desired position, the hydraulic control unit 204 displaces the first cam plate 188 to the right side in FIG. 8D and lowers the contact position between the plunger 182*b* and the first cam plate 188. Thereby, the plunger 182*b* is not pushed into the pump cylinder 182*a* even at the crank angle close to the bottom dead center, and the plunger pump 182 is not operated. That is, the pressing of the hydraulic oil into the first hydraulic pressure chamber 168*a* is stopped.

Thereby, the hydraulic pressure adjustment mechanism 196 adjusts the entering position of the piston rod 112*a* for the first hydraulic pressure chamber 168*a* in the stroke direction. The variable mechanism adjusts the hydraulic pressure of the first hydraulic pressure chamber 168*a* by means of the hydraulic pressure adjustment mechanism 196, and changes the relative position between the piston rod 112*a* and the crosshead 114 in the stroke direction. Thereby, the positions of the top and bottom dead centers of the piston 112 can be varied.

Figure 9:
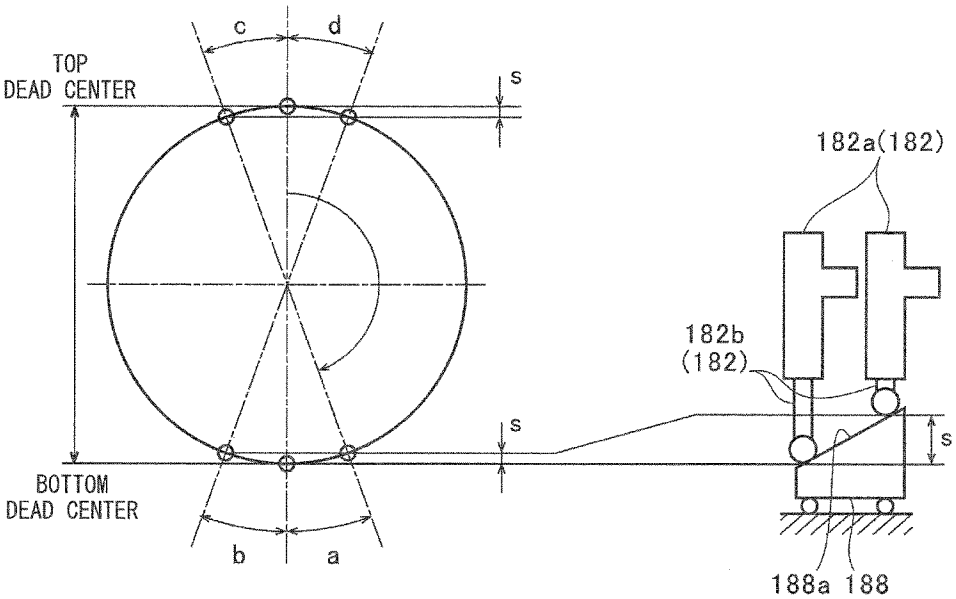
FIG. 9 is a view showing the operation timings of a crank angle, the plunger pump and the spill valve.

FIG. 9 is a view showing operation timings of the plunger pump 182 and the spill valve 184 and a crank angle. In FIG. 9, for the convenience of description, the two plunger pumps 182 in which the contact position of the first cam plate 188 with the inclined surface 188*a* differs are shown side by side. However, the actual number of the plunger pump 182 is one, and the contact position with the plunger pump 182 is displaced by the displacement of the first cam plate 188. Also, the spill valve 184 and the second cam plate 190 are not shown.

As shown in FIG. 9, a range of the crank angle from just before the bottom dead center to the bottom dead center is defined as an angle a, and a range of the crank angle equivalent to a phase angle having the same magnitude as the angle a from the bottom dead center is defined as an angle b. Also, the range of the crank angle from just before the top dead center to the top dead center is defined as an angle c, and the range of the crank angle equivalent to a phase angle having the same magnitude as the angle c from the top dead center is defined as an angle d.

When the relative position between the plunger pump 182 and the first cam plate 188 is in a state in which it is indicated by the plunger pump 182 shown at the right side in FIG. 9, the plunger 182*b* of the plunger pump 182 starts contact with the inclined surface 188*a* of the first cam plate 188 at a start position of the angle a at which the crank angle starts, and exceeds the bottom dead center to release the contact at an end position of the angle b. In FIG. 9, a stroke width of the plunger pump 182 is indicated by a width s.

Also, when the relative position between the plunger pump 182 and the first cam plate 188 is in a state in which it is indicated by the plunger pump 182 shown at the left side in FIG. 9, the plunger 182*b* of the plunger pump 182 comes into contact with the inclined surface 188*a* at a position at which the crank angle becomes the bottom dead center, but the plunger 182*b* immediately releases the contact without being pushed into the pump cylinder 182*a*.

In this way, the plunger pump 182 is operated when the crank angle is within the range of the angle a. To be specific, when the crank angle is within the range of the angle a, the plunger pump 182 presses the hydraulic oil into the first hydraulic pressure chamber 168*a*.

Also, the spill valve 184 is operated when the crank angle is within the range of the angle b. To be specific, when the crank angle is within the range of the angle b, the spill valve 184 discharges the hydraulic oil from the first hydraulic pressure chamber 168*a*.

Here, the case in which the plunger pump 182 is operated when the crank angle is within the range of the angle a, and the case in which the spill valve 184 is operated when the crank angle is within the range of the angle b have been described. However, the plunger pump 182 may be operated when the crank angle is within the range of the angle c, and the spill valve 184 may be operated when the crank angle is within the range of the angle d. In this case, when the crank angle is within the range of the angle c, the plunger pump 182 presses the hydraulic oil into the first hydraulic pressure chamber 168*a*. Also, when the crank angle is within the range of the angle d, the spill valve 184 discharges the hydraulic oil from the first hydraulic pressure chamber 168*a*.

When the plunger pump 182 or the spill valve 184 is operated in a stroke range excluding the top dead center or the bottom dead center, the first cam plate 188, the second cam plate 190, the first actuator 192, the second actuator 194, and so on, should be displaced in synchronization with the reciprocation of the plunger pump 182 or the spill valve 184. However, as in the present embodiment, when the plunger pump 182 or the spill valve 184 is operated in the vicinity of the top dead center or the bottom dead center, this synchronization mechanism may not be provided, and costs can be reduced.

However, when the plunger pump 182 and the spill valve 184 are operated in the angle ranges (the angle a and the angle b) in which the crank angle include the bottom dead center, the hydraulic oil can be easily pressed into the first hydraulic pressure chamber 168*a* from the plunger pump 182 because the pressure inside the cylinder 110 is low. Further, the hydraulic pressure of the hydraulic oil discharged from the spill valve 184 is also low, and it is possible to suppress generation of cavitation and to keep the load operating the spill valve 184 low. Furthermore, it is possible to avoid a situation in which the position of the piston 112 becomes unstable because the pressure of the hydraulic oil is high.

As described above, the uniflow scavenging two-cycle engine 100 is equipped with the variable mechanism that changes the relative position between the piston rod 112*a* and the crosshead 114 in the stroke direction of the piston 112, and can change the compression ratio in a simple structure while being operated.

Also, since the constitution in which the entering position of the piston rod 112*a* for the connecting hole 160 is adjusted by the hydraulic pressure is employed, the uniflow scavenging two-cycle engine 100 is excellent in durability against high temperatures and can also perform fine adjustment of the compression ratio.

Also, since the plunger pump 182 is configured to press the hydraulic oil into the first hydraulic pressure chamber 168*a* using the reciprocating force of the crosshead 114, a hydraulic pump generating a high pressure is not required, and costs can be reduced.

Also, since the maximum pushing amount of the plunger 182*b* for the pump cylinder 182*a* can be adjusted by the first cam plate 188 and the first actuator 192, the fine adjustment of the compression ratio can be facilitated by adjusting an inwardly pressed amount of the hydraulic oil. For example, the hydraulic oil equivalent to the maximum volume of the oil storage chamber 182*e* may be pressed into the first hydraulic pressure chamber 168*a* in one stroke. The relative position of the first cam plate 188 may be adjusted, and the hydraulic oil equivalent to half the amount of the maximum volume of the oil storage chamber 182*e* may be pressed into the first hydraulic pressure chamber 168*a* in one stroke. In this way, the amount of the hydraulic oil pressed into the first hydraulic pressure chamber 168*a* in one stroke can be arbitrarily-set within a range of the maximum volume of the oil storage chamber 182*e*.

For example, when the hydraulic oil leaks from the first hydraulic pressure chamber 168*a*, the amount of the hydraulic oil pressed into the first hydraulic pressure chamber 168*a* in one stroke may be set to compensate for the amount of leakage and to press the hydraulic oil into the first hydraulic pressure chamber 168*a* from the plunger pump 182 at all times.

Also, since the inclined surface 188*a* is provided for the first cam plate 188, the first actuator 192 only displaces the first cam plate 188 in a horizontal direction, and thereby the amount of the hydraulic oil pressed into the first hydraulic pressure chamber 168*a* in one stroke can be easily set.

Also, since the spill valve 184 is configured to be opened/closed using the reciprocating force of the crosshead 114, a hydraulic pump generating a high pressure is not required to open the spill valve 184, and costs can be reduced.

Also, since the maximum pushing amount of the rod 184*c* for the main body 184*a* of the spill valve 184 can be adjusted by the second cam plate 190 and the second actuator 194, the discharged amount of the hydraulic oil per stroke is adjusted, and fine adjustment of the compression ratio can be conducted.

Also, since the inclined surface 190*a* is provided for the second cam plate 190, the second actuator 194 only displaces the second cam plate 190 in a horizontal direction, and thereby the amount of the hydraulic oil discharged from the first hydraulic pressure chamber 168*a* in one stroke can be easily set.

In the aforementioned embodiment, the case in which the first actuator 192 and the second actuator 194 change the relative positions of the first cam plate 188 and the second cam plate 190 with respect to the plunger 182*b* and the rod 184*c* has been described. However, the first actuator 192 and the second actuator 194 may change postures of the first cam plate 188 and the second cam plate 190, and thereby may change the contact positions with the first cam plate 188 and the second cam plate 190.

Further, in the aforementioned embodiment, the case in which both of the plunger pump 182 and the spill valve 184 are provided as the hydraulic pressure adjustment mechanism 196 has been described. However, only any one of the plunger pump 182 and the spill valve 184 may be provided, and neither the plunger pump 182 nor the spill valve 184 may be provided. In any case, as long as the hydraulic pressure adjustment mechanism 196 can supply the hydraulic oil to the first hydraulic pressure chamber 168*a* or discharge the hydraulic oil from the first hydraulic pressure chamber 168*a*, and adjust the entering position of the end of the piston rod 112*a* for the first hydraulic pressure chamber 168*a* in the stroke direction, the present disclosure is not limited to a specific constitution therefor.

Although a preferred embodiment of the present disclosure has been described above with reference to the attached drawings, it goes without saying that the present disclosure is not limited to this embodiment. It will be apparent to those skilled in the art that various modifications or alterations can be contrived and implemented within the scope described in the claims, and it is naturally understood that these modifications and alterations also fall within the technical scope of the present disclosure.

INDUSTRIAL APPLICABILITY

The present disclosure can be used in the crosshead engine in which the crosshead is fixed to the piston rod.

What is claimed is:

1. A crosshead engine comprising:

a cylinder;

a piston configured to slide in the cylinder;

a piston rod having one end fixed to the piston;

a crosshead connected to the other end side of the piston rod and configured to reciprocate together with the piston;

a connecting rod having one end supported by the crosshead;

a crankshaft connected to the connecting rod and configured to rotate in coordination with the reciprocation of the piston and the reciprocation of the crosshead; and a variable mechanism configured to vary positions of top and bottom dead centers of the piston by changing a relative position of the piston rod and the crosshead in a stroke direction of the piston, wherein the variable mechanism comprises a hydraulic pressure chamber which is provided in the crosshead and into which an end of the piston rod is inserted; and a hydraulic pressure adjustment mechanism which supplies hydraulic oil to the hydraulic pressure chamber or discharges the hydraulic oil from the hydraulic pressure chamber and which adjusts an entering position at which the end of the piston rod is inserted into the hydraulic pressure chamber in the stroke direction.

2. The crosshead engine according to claim 1, wherein:

the hydraulic pressure adjustment mechanism further includes a plunger pump that has a pump cylinder into which the hydraulic oil is guided, and a plunger that moves in the pump cylinder in the stroke direction and has one end protruding from the pump cylinder, and that supplies the hydraulic oil in the pump cylinder to the hydraulic pressure chamber when the plunger is pushed into the pump cylinder; and the plunger pump moves in the stroke direction along with the crosshead, and the plunger is pushed into the pump cylinder by receiving a reaction force opposite to a reciprocating force of the crosshead.

3. The crosshead engine according to claim 2, wherein:

the hydraulic pressure adjustment mechanism further includes a first cam plate that comes into contact with the plunger according to the movement of the plunger pump in the stroke direction, and a first actuator that displaces the first cam plate to change a posture of the first cam plate or a relative position of the first cam plate with respect to the plunger; and the plunger is subjected to a change in a contact position with the first cam plate in the stroke direction depending on the posture or the relative position of the first cam plate, and a maximum pushing amount thereof for the pump cylinder is set by the contact position.

4. The crosshead engine according to claim 3, wherein the first cam plate has an inclined surface that comes into contact with the one end of the plunger, and the first actuator displaces the first cam plate in a direction intersecting the stroke direction.

5. The crosshead engine according to claim 1, wherein:

the hydraulic pressure adjustment mechanism further includes a spill valve that has a main body in which an internal flow passage in which the hydraulic oil discharged from the hydraulic pressure chamber circulates is formed, a valve body that is displaced to a closed position at which the valve body moves in the internal flow passage in the stroke direction to block the internal flow passage and to an opened position at which the circulation of the hydraulic oil is allowed in the internal flow passage, and a rod that has one end facing the valve body in the stroke direction and the other end protruding from the main body, and that is displaced to the opened position when the rod is pushed into the main body and the valve body is pressed against the rod;

the spill valve moves in the stroke direction along with the crosshead, and the rod is pushed into the main body by receiving the reaction force opposite to the reciprocating force of the crosshead.

6. The crosshead engine according to claim 2, wherein:

the hydraulic pressure adjustment mechanism further includes a spill valve that has a main body in which an internal flow passage in which the hydraulic oil discharged from the hydraulic pressure chamber circulates is formed, a valve body that is displaced to a closed position at which the valve body moves in the internal flow passage in the stroke direction to block the internal flow passage and to an opened position at which the circulation of the hydraulic oil is allowed in the internal flow passage, and a rod that has one end facing the valve body in the stroke direction and the other end protruding from the main body, and that is displaced to the opened position when the rod is pushed into the main body and the valve body is pressed against the rod;

the spill valve moves in the stroke direction along with the crosshead, and the rod is pushed into the main body by receiving the reaction force opposite to the reciprocating force of the crosshead.

7. The crosshead engine according to claim 3, wherein:

the hydraulic pressure adjustment mechanism further includes a spill valve that has a main body in which an internal flow passage in which the hydraulic oil discharged from the hydraulic pressure chamber circulates is formed, a valve body that is displaced to a closed position at which the valve body moves in the internal flow passage in the stroke direction to block the internal flow passage and to an opened position at which the circulation of the hydraulic oil is allowed in the internal flow passage, and a rod that has one end facing the valve body in the stroke direction and the other end protruding from the main body, and that is displaced to the opened position when the rod is pushed into the main body and the valve body is pressed against the rod;

the spill valve moves in the stroke direction along with the crosshead, and the rod is pushed into the main body by receiving the reaction force opposite to the reciprocating force of the crosshead.

8. The crosshead engine according to claim 4, wherein:

the hydraulic pressure adjustment mechanism further includes a spill valve that has a main body in which an internal flow passage in which the hydraulic oil discharged from the hydraulic pressure chamber circulates is formed, a valve body that is displaced to a closed position at which the valve body moves in the internal flow passage in the stroke direction to block the internal flow passage and to an opened position at which the circulation of the hydraulic oil is allowed in the internal flow passage, and a rod that has one end facing the valve body in the stroke direction and the other end protruding from the main body, and that is displaced to the opened position when the rod is pushed into the main body and the valve body is pressed against the rod;

the spill valve moves in the stroke direction along with the crosshead, and the rod is pushed into the main body by receiving the reaction force opposite to the reciprocating force of the crosshead.

9. The crosshead engine according to claim 5, wherein:

the hydraulic pressure adjustment mechanism further includes a second cam plate that comes into contact with the rod according to the movement of the spill valve in the stroke direction, and a second actuator that displaces the second cam plate to change a posture of the second cam plate or a relative position of the second cam plate with respect to the rod; and the rod is subjected to a change in a contact position with the second cam plate in the stroke direction depending on the posture or the relative position of the second cam plate, and a maximum pushing amount thereof for the spill valve is set by the contact position.

10. The crosshead engine according to claim 6, wherein:

the hydraulic pressure adjustment mechanism further includes a second cam plate that comes into contact with the rod according to the movement of the spill valve in the stroke direction, and a second actuator that displaces the second cam plate to change a posture of the second cam plate or a relative position of the second cam plate with respect to the rod; and the rod is subjected to a change in a contact position with the second cam plate in the stroke direction depending on the posture or the relative position of the second cam plate, and a maximum pushing amount thereof for the spill valve is set by the contact position.

11. The crosshead engine according to claim 7, wherein:

the hydraulic pressure adjustment mechanism further includes a second cam plate that comes into contact with the rod according to the movement of the spill valve in the stroke direction, and a second actuator that displaces the second cam plate to change a posture of the second cam plate or a relative position of the second cam plate with respect to the rod; and the rod is subjected to a change in a contact position with the second cam plate in the stroke direction depending on the posture or the relative position of the second cam plate, and a maximum pushing amount thereof for the spill valve is set by the contact position.

12. The crosshead engine according to claim 8, wherein:

the hydraulic pressure adjustment mechanism further includes a second cam plate that comes into contact with the rod according to the movement of the spill valve in the stroke direction, and a second actuator that displaces the second cam plate to change a posture of the second cam plate or a relative position of the second cam plate with respect to the rod; and the rod is subjected to a change in a contact position with the second cam plate in the stroke direction depending on the posture or the relative position of the second cam plate, and a maximum pushing amount thereof for the spill valve is set by the contact position.

13. The crosshead engine according to claim 9, wherein:

the second cam plate has an inclined surface that comes into contact with the one end of the rod; and the second actuator displaces the second cam plate in the direction intersecting the stroke direction.

14. The crosshead engine according to claim 10, wherein:

the second cam plate has an inclined surface that comes into contact with the one end of the rod; and the second actuator displaces the second cam plate in the direction intersecting the stroke direction.

15. The crosshead engine according to claim 11, wherein:

the second cam plate has an inclined surface that comes into contact with the one end of the rod; and the second actuator displaces the second cam plate in the direction intersecting the stroke direction.

16. The crosshead engine according to claim 12, wherein:

the second cam plate has an inclined surface that comes into contact with the one end of the rod; and the second actuator displaces the second cam plate in the direction intersecting the stroke direction.

* * * * *